United States Patent [19]

Hines

[11] Patent Number: 4,465,997

[45] Date of Patent: Aug. 14, 1984

[54] EXTERIOR MOUNTED DOOR AND WINDOW ALARM SWITCH

[75] Inventor: Thomas N. Hines, Grand Rapids, Mich.

[73] Assignee: Security Network International, Inc., Grand Rapids, Mich.

[21] Appl. No.: 228,153

[22] Filed: Jan. 26, 1981

[51] Int. Cl.[3] ..... G08B 13/08

[52] U.S. Cl. ..... 340/542; 340/545; 340/549; 200/61.68

[58] Field of Search ..... 340/545, 549; 200/61.64, 61.67, 61.68

[56] References Cited

U.S. PATENT DOCUMENTS

| | | | |
|---|---|---|---|
| 2,226,086 | 12/1941 | Schlage | 200/55 |
| 2,467,815 | 4/1949 | Curtiss, Jr. | 200/61.68 |
| 2,516,163 | 7/1950 | Vaughan | 200/54 |
| 2,600,350 | 6/1952 | Webster et al. | 200/61.67 |
| 2,615,083 | 10/1952 | Krueger | 177/314 |
| 2,756,300 | 7/1956 | Thiberville | 200/61.67 |
| 3,197,588 | 7/1965 | Baldwin et al. | 200/61.68 |
| 3,259,707 | 7/1966 | Eickhoff | 200/61.67 |
| 3,299,229 | 1/1967 | Lombardi | 200/61.67 X |
| 3,435,643 | 4/1969 | Pollak et al. | 340/545 X |
| 3,453,613 | 7/1969 | Kay | 340/549 |
| 3,525,830 | 8/1970 | Hawkins | 340/545 X |
| 3,623,062 | 11/1971 | Hawkins | 340/274 |
| 3,643,249 | 2/1972 | Haywood | 340/274 |
| 3,710,052 | 1/1973 | Jette, Jr. | 200/61.68 |
| 3,796,452 | 3/1974 | Foster et al. | 200/61.64 X |
| 3,810,145 | 5/1974 | Gusaras | 340/274 |
| 3,866,164 | 2/1975 | Peterson | 340/274 |
| 3,866,201 | 2/1975 | Beiswenger | 340/274 |
| 3,939,315 | 2/1976 | Schlage | 200/61.64 |
| 3,967,080 | 6/1976 | Errani | 200/61.64 |
| 3,968,337 | 7/1976 | Cole | 200/61.62 |
| 4,006,471 | 2/1977 | Pappas | 340/545 X |

*Primary Examiner*—Glen R. Swann, III

*Attorney, Agent, or Firm*—Varnum, Riddering, Schmidt & Howlett

[57] ABSTRACT

An alarm switch for indicating when a latch or dead bolt for a door or window is locked or unlocked comprises a switch casing adapted for mounting on the exterior portion of the door or window frame or door or window; an electrical contact assembly mounted in the casing; a contact assembly actuating member mounted in the casing in position to change the electrical state of the contact assembly by movement of the actuating member from a deactuated to an actuated position, the actuating member being resiliently biased toward its deactuated position but being in position to engage the dead bolt or latch and move to its actuated position when the door or window is shut and the dead bolt or latch is locked, the actuating member being accessible to the door or window latch or dead bolt through an opening in the casing; and electrical terminals on the contact assembly adapted to be connected to leads leading to a remote alarm system that indicates to the alarm circuit when the door or window bolt or latch is opened. Separate switches are provided for side hinged doors having side mounted and bottom mounted dead bolts; for surface mounted dead bolts that are used on overhead doors or the like; and for emergency doors operated by a so-called panic bar. These switches may also be used for certain types of windows.

12 Claims, 19 Drawing Figures

EXTERIOR MOUNTED DOOR AND WINDOW ALARM SWITCH

BACKGROUND OF THE INVENTION

1. Field of the Invention

This invention relates to door and window alarm switches and more particularly to an exterior mounted door or window alarm switch adapted to be mounted on existing door or window systems with little or no modification and connected to conventional alarm systems.

2. Description of the Prior Art

Alarm systems for indicating when doors are opened or closed are well known. Some such alarm systems are responsive to the opening and closing of the door itself, while others are responsive to the opening and closing of a dead bolt or a door latch.

Systems that are responsive to the opening and closing of a dead bolt or door latch generally are incorporated into a special door latch or dead bolt system that is substituted for a conventional door latch system that might already be in existence on the doors in an existing installation. Installation of equipment of this nature is a costly and time-consuming procedure.

One type of switch system for indicating when a dead bolt or door latch is closed employs a microswitch mounted in the recess in the door frame for the door latch or dead bolt. Such microswitches are very small and lightweight and are easily damaged by the type of rough treatment many doors receive.

One of the principal objects of the present invention is to provide an alarm switch for a door latch or dead bolt that can be used with virtually any pre-existing door latch system and can be mounted on an exterior portion of the door or door frame so that tiny and easily damaged microswitches do not have to be used in the installation. It is an objective of the present invention to provide a simple, rugged alarm switch mechanism that can be used to easily and inexpensively retrofit virtually all of the doors in an existing installation, without requiring any complicated new door hardware and without requiring a completely new alarm system.

SUMMARY OF THE INVENTION

In accordance with the present invention, an alarm switch for indicating when a latch or dead bolt for a door is opened comprises a switch casing adapted to be mounted on the exterior portion of the door frame or the door; an electrical contact assembly mounted in the casing; a contact assembly actuating member movably mounted in the casing in position to change the electrical state of the contact assembly by movement of the actuating member from a deactuated to an actuated position, the actuating member being resiliently biased toward it deactuated position but being positioned to engage the door bolt or latch and move to its actuated position when the door is shut and the door bolt or latch is locked, the actuating member being accessible to the door latch or door bolt through an opening in the casing; and electrical terminals on the switch adapted to be connected to leads leading to a remote alarm system that indicates to the alarm circuit when the door bolt or latch is opened.

In one aspect of the present invention, the switch is mounted on a door frame for a side hinged door employing a side operated dead bolt. The switch casing is mounted adjacent the recess in the door for the dead bolt. The actuating member comprises a pivotable toggle member having an arm extending through an opening in the casing facing the door frame. The toggle member is adapted to extend through an opening formed in the door frame leading to the interior of the lock bolt recess. The toggle is positioned such that it is engaged by the door bolt when the door bolt is closed and pivoted to a position wherein the alarm switch is actuated.

The contact assembly comprises a single or multiple throw configuration that is adapted to be connected to an alarm system such that the system can be activated when the bolt is closed. If the bolt is opened after the alarm is activated an alarm signal is produced.

In another aspect of the present invention, the same type of switch casing is employed in a side hinged door having a vertically extending dead bolt system wherein the dead bolt extends vertically into a recess adjacent the top or bottom of the door. In this switch, however, the casing is mounted in or on the door and the toggle includes a clip on the outer end that resiliently grips the dead bolt. When the dead bolt is moved vertically, the toggle pivots with the movement of the dead bolt and changes the state of the alarm switch.

In another aspect of the present invention, the alarm switch can be employed with a surface mounted dead bolt system, such as that employed on an overhead door or the like. In a conventional overhead door, the dead bolt is slideably mounted on the surface of the door adjacent to the side edge of the door, and the door is locked by moving the dead bolt in a sideways direction through an opening in the runner at the side of the door. Typically the runner is metal and the dead bolt extends through an opening in the runner.

In this type of application, the switch casing is fastened to the wall or the runner adjacent the side edge of the door, with an opening in the casing being positioned to receive the dead bolt after it passes through the runner. A transversely movable roller is positioned in the casing to engage the bolt as it enters the casing. When the roller enters the casing it moves the roller transversely and thereby changes the state of the alarm switch.

In another aspect of the present invention, the alarm switch can be employed in an emergency door or the like, wherein the door is opened by a latch actuated by a so-called panic bar. In such a system the door itself bears against a door stop member, which is in a strip extending along the inner edge of the door frame. The latch holds the door in its closed position by protruding outwardly on the other side of the door stop member. The switch casing of the present invention is mounted in the door stop member so as to receive the latch when it protrudes to its outward position. A pivotable plate on the switch casing is pivoted inwardly when the latch is extended, and this causes actuation of the alarm switch.

These and other features of the present invention will hereinafter appear. For purposes of illustration, but not of limitation, the preferred embodiments of the present invention are described in detail below and shown in the appended drawings.

DETAILED DESCRIPTION OF THE PREFERRED EMBODIMENT

Figure 1:
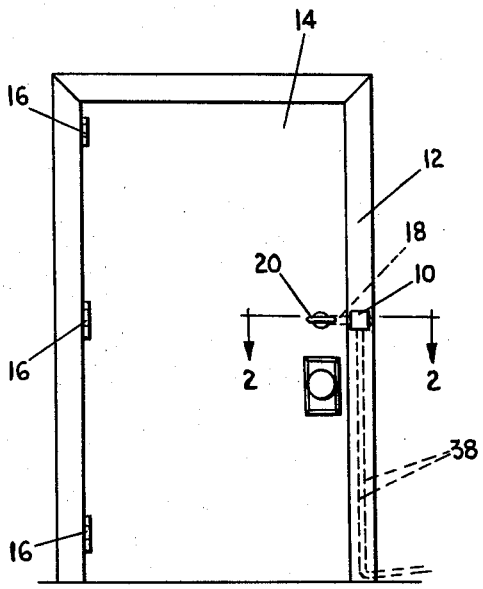
FIG. 1 is an elevational view showing the alarm switch of the present invention employed in connection with a side acting dead bolt on a side hinged door.

Referring now to the drawings, an alarm switch 10 is shown for illustrative purposes in FIG. 1 mounted on the door frame 12 of a conventional side hinged door 14. It should be understood that the switch also could be employed on a double door system or window.

Figure 2:
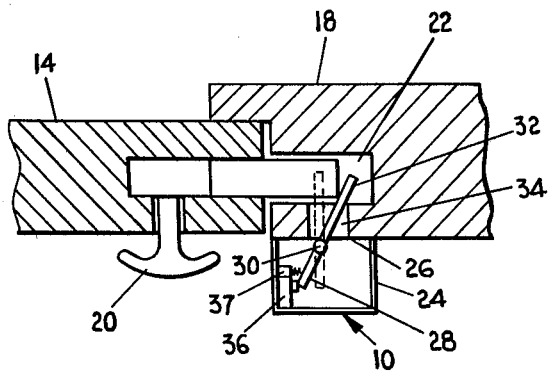
FIG. 2 is a view taken along lines 2—2 of FIG. 1.

Door 14 is hinged on the left side for exemplary purposes by means of hinges 16. The door includes a side acting dead bolt 18 mounted on the right side of the door and actuated by a T-shaped handle 20 or by a key lock (not shown). The dead bolt moves from a retracted position where it is withdrawn inside the door to an extended position (as shown in FIG. 2) wherein it protrudes into a dead bolt recess 22 in the inside edge of the door frame.

Switch 10 is mounted on the door frame immediately over the dead bolt recess therein. The switch includes a casing 24 having an open side 26 abutting the door frame. A toggle 28 is pivotably mounted and has a vertical pivot shaft 30 adjacent the open side of the casing. The toggle includes an outwardly extending portion 32 that protrudes through an opening 34 drilled in the door frame. The toggle extends through this opening into the recess for the dead bolt. When the dead bolt is locked, the toggle is pivoted to the position shown in FIG. 2, and in this position, the toggle actuates or changes the state of contact assembly 36, which is mounted in the interior of the casing.

A spring assembly 37 is glued on the end of the contact assembly 36 to resiliently urge the toggle 28 to its "normal" position after the bolt is no longer in contact with it. The spring assembly 37 consists of a casing holder 45 and spring 41.

Figure 6:
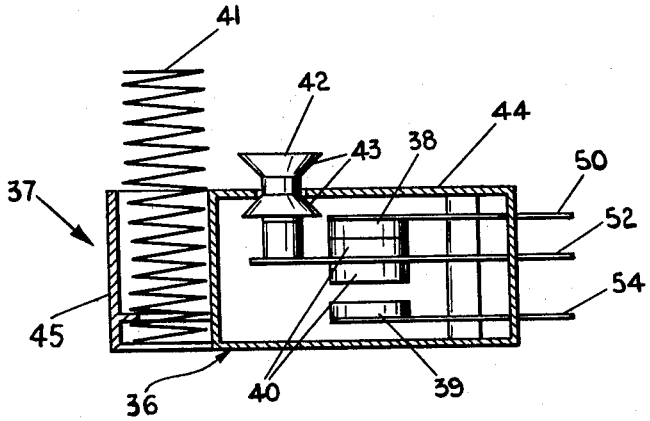
FIG. 6 is a cross-sectional view showing the internal components of the electrical contact assembly and spring assembly employed in the alarm switch of FIG. 1.
Figure 7:
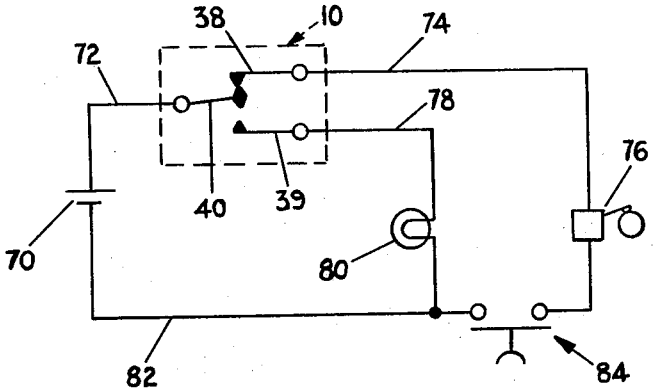
FIG. 7 is a schematic electrical diagram of an alarm system employing the alarm switch of FIG. 1.

Terminals 50, 52, and 54 (FIG. 5) of contact assembly 36 are connected to a terminal assembly 58 (FIG. 3) which in turn is connected to electrical leads 38 that extend downwardly through the interior of the door frame (FIG. 1) and then to an appropriate alarm system of conventional design (shown schematically in FIG. 7). The leads also could be surface mounted on the door frame or the like. The details of electrical contact assembly 36 are shown in FIG. 5–7.

Contact assembly 36 comprises a single-pole, double throw design (although it could be in various pole and throw combinations) having three contact elements, two stationary contact elements 38 and 39 and a movable contact element 40 positioned for movement between the stationary contact elements. A flat, T-shaped actuating bar or button 42 is placed against the movable contact element and protrudes through an opening in the top of casing 44 of the contact assembly. Movable contact element 40 is resiliently biased to engage contact element 38 with the actuating bar 42 protruding outwardly through the top of the casing. Inward pressure on bar 42 causes the contact element 40 to disengage contact element 38 and engage contact element 45. Tapered rubber grommets 43 fit on bar 42 on both sides of the opening in the casing. These grommets engage the opening in the casing when the bar is outwardly extended or depressed and minimize moisture and dust infiltration into the contact assembly.

Figure 4:
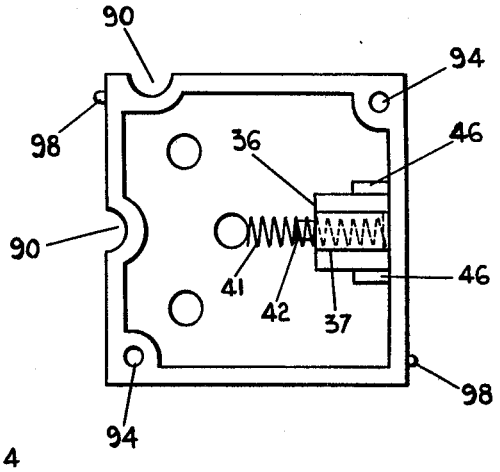
FIG. 4 is an internal view of the switch casing of FIG. 1, taken through the open end of the casing.
Figure 5:
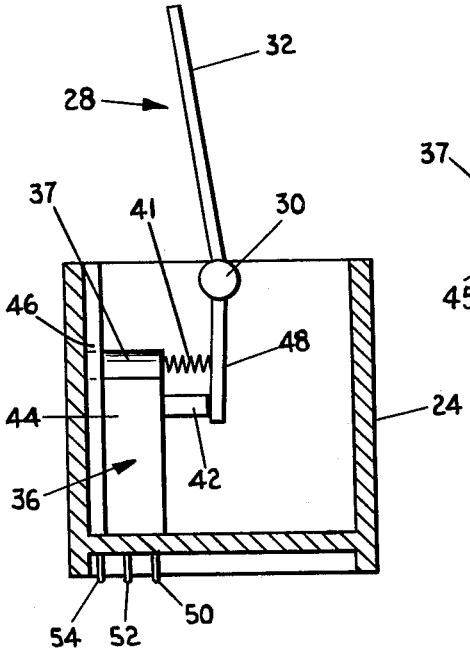
FIG. 5 is a cross-sectional view of the switch casing of FIG. 1.

As shown in FIGS. 4 and 5, contact assembly 36 and spring assembly 37 are mounted in the interior of the casing between two ridges 46. In this position, actuating bar 42 and spring 41 are positioned to engage an inwardly extending portion 48 of toggle 28 when the toggle is pivoted in a clockwise direction (FIG. 5 orientation).

Figure 3:
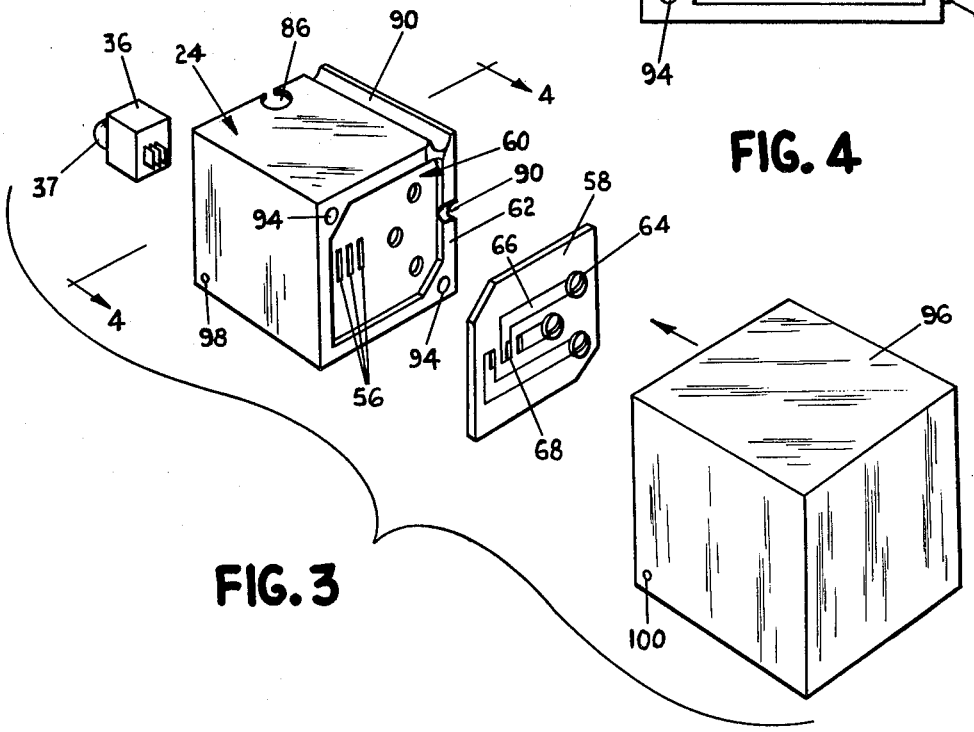
FIG. 3 is an exploded perspective view of the alarm switch of FIG. 1.

The outer ends of contact elements 38, 40 and 39 comprise respectively terminals 50, 52 and 54 that protrude outwardly from the contact assembly. As shown in FIG. 3, these terminals fit through recessed slots 56 in the outer end of the switch casing 24. A terminal assembly 58 fits in a recess 60 in outer end 62 of the casing. The terminal assembly is formed of non-conductive material and includes three fasteners such as screws 64 threaded in the terminal assembly and connected by conductive strips 66 to each of three slots 68 that mate with slots 56 and engage the terminals 50, 52 and 54 on the contact assembly by means of soldering.

Terminal screws 64 are connected to lead wires 38 that extend to a suitable alarm system. The lead wires can run inside the door frame (as illustrated) or they could be surface mounted.

One way in which an alarm system can be actuated by the switch of the present invention is shown in a schematic circuit diagram in FIG. 7. A battery or other type of power supply 70 is connected to alarm switch 10 through lead 72. One lead 74 electrically connects contact 38 with audible alarm 76 of conventional design. Another lead 78 electrically connects contact 39 to light 80. Audible alarm 76 is connected to lead 82 and the power source by means of a manually actuatable switch 84.

The alarm switch of the present invention functions in the following manner. At the close of the day, all of the doors in a given installation are closed and locked, with all of the dead bolts placed in their extended or locked positions. This causes the terminal 40 of each contact assembly to be connected with terminal 39 of each contact assembly. At that point, switch 84 is closed, thus activating audible alarm 76. If any door is thereafter opened with or without a key, terminal 40 of the accompanying alarm switch will disengage terminal 39 and will engage terminal 38 causing light 80 to go out and audible alarm 76 to sound. The operator at a central alarm system will not only receive an audible signal that a door has been opened but he will also receive a light signal indicating which door has been opened.

Referring again to FIG. 3, casing 24 includes circular openings 86 at the center of the upper and lower surfaces thereof. These openings house pivot shaft 30 (shown in FIGS. 2 and 5). Longitudinal grooves or wire guides 90 are formed in the side wall and end thereof for housing electrical leads.

The casing is mounted to the door frame by screws which fit through longitudinal openings 94 and into the door frame. The terminal assembly 58 fits in the recessed opening in the end of the cover, with the lead connected to the terminal screws going down either of the longitudinal grooves 90. The whole casing is enclosed by means of a cover 96. Cover 96 fits snugly over the outer surface of the casing and is held in place on the casing by means of two circular protrusions 98 positioned diagonally across from each other on the sides of the casing that fit into corresponding circular openings 100 on the cover.

When thus installed the switch presents an unobtrusive exterior and the electrical leads and terminals are completely enclosed.

Figure 9:
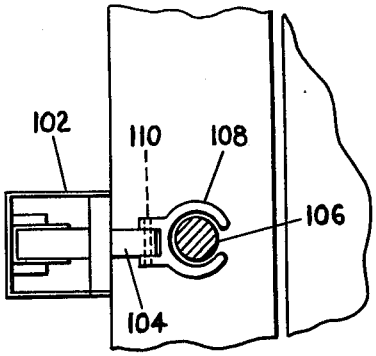
FIG. 9 is a view taken along lines 9—9 of FIG. 8.
Figure 8:
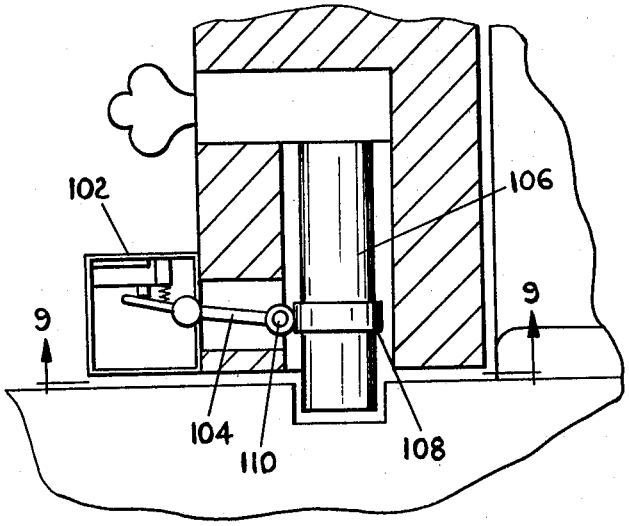
FIG. 8 is a second embodiment of the present invention, showing the alarm switch connected to a flush bolt assembly in a side hinged door.
Figure 10:
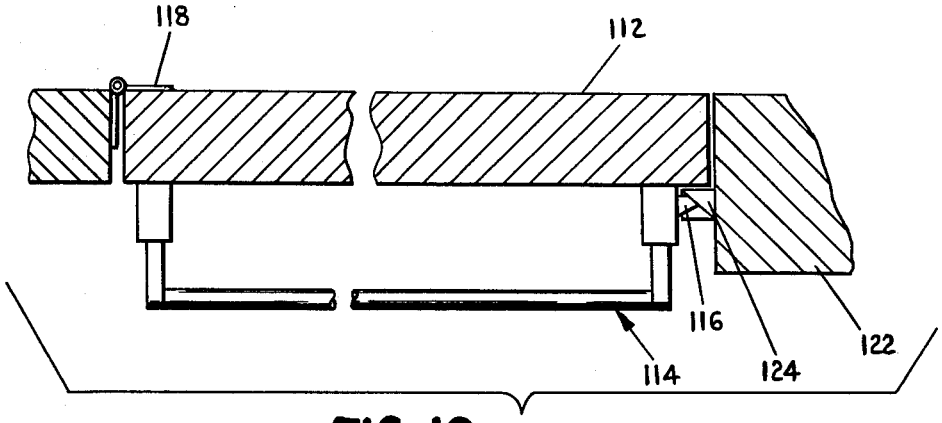
FIG. 10 is a third embodiment of the present invention, showing an alarm switch used in connection with an emergency door operated by a panic bar.

A modified embodiment of the present invention for indicating when a flush bolt (i.e., a vertically extending dead bolt) is retracted is shown in FIGS. 8 and 9. In a flush bolt system, the bolt fits into a hole in the floor or door frame, so it is impossible to place the alarm switch in a position comparable to the door frame shown in FIG. 1.

In this apparatus, alarm switch 102 is mounted on the door itself and has a toggle 104 extending into engagement with the flush bolt 106 of the door system. The basic alarm switch is substantially the same as the alarm switch in FIG. 1, so the details will not be described again herein. The main difference between the alarm switch and the switch of FIG. 1 is that a bar clip 108 is mounted by means of a swivel 110 at the end of toggle 104. This bar clip resiliently snaps over flush bolt 106 so that the toggle moves upwardly and downwardly along with the movement of the bolt.

Another embodiment of the present invention is shown in FIGS. 10–14. This embodiment is intended for use as an alarm switch used for an emergency door 112 or the like, when the door is opened by a panic bar 114. Panic bar 114 comprises a lever and a latch 116 positioned at the edge of a side hinged door. In an emergency door of the type shown in FIG. 10, the door pivots outwardly on a hinge 118 and when closed rests against a door stop 120 (shown in FIG. 11), which is a vertical strip extending along the inner edge of the door frame 122. Latch 116 holds the door in its closed position by bearing against the inner lip of switch 124, while the door bears against the outer side of the door stop 120.

Figure 11:
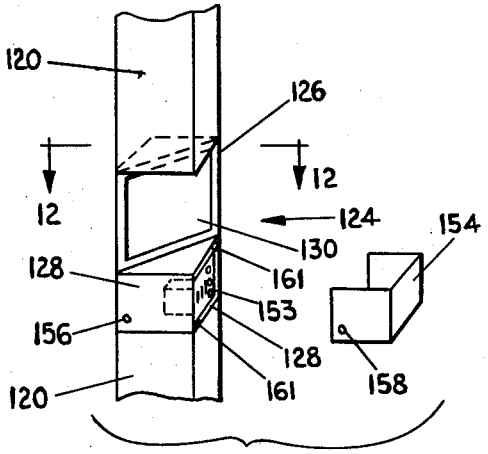
FIG. 11 is a perspective view of the alarm switch of FIG. 10.

The opening of latch 116 by the pivotal movement of panic bar 114 is indicated by means of an alarm switch 124 which is mounted in a removed section of the door stop 120 as shown in FIG. 11. Switch 124 comprises a casing having a beveled upper section 126 and a lower section 128. The angled portion of casing 126 is open and houses a plate 130 pivotably mounted therein by means of a pivot shaft 132 (see FIG. 12).

Figure 14:
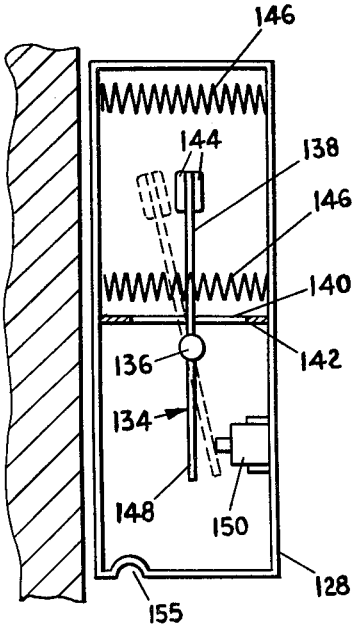
FIG. 14 is a view taken along lines 14—14 of FIG. 12.
Figure 15:
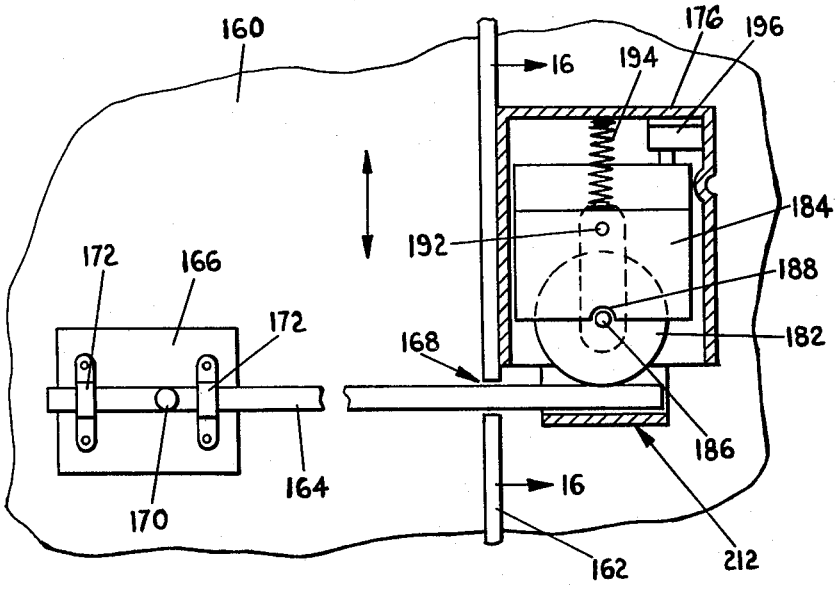
FIG. 15 is a fourth embodiment of the present invention, wherein the alarm switch is used in connection with a surface mounted dead bolt on an overhead door, the casing being removed to show the internal components of the alarm switch.

As FIG. 14 shows, lower portion 128 of the casing houses a pivotally mounted toggle 134 which is integrally formed with a horizontal pivot shaft 136. An upper end 138 of the toggle extends through an opening in a wall 142 separating the upper and lower portions of the casing and fits within a pair of holding projections 144 mounted on the back of plate 130. Springs 146 urge the plate in an outward direction.

Figure 12:
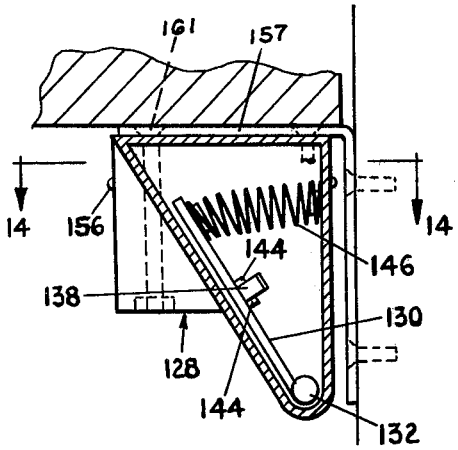
FIG. 12 is a view taken along lines 12—12 of FIG. 11, casing structure removed.
Figure 13:
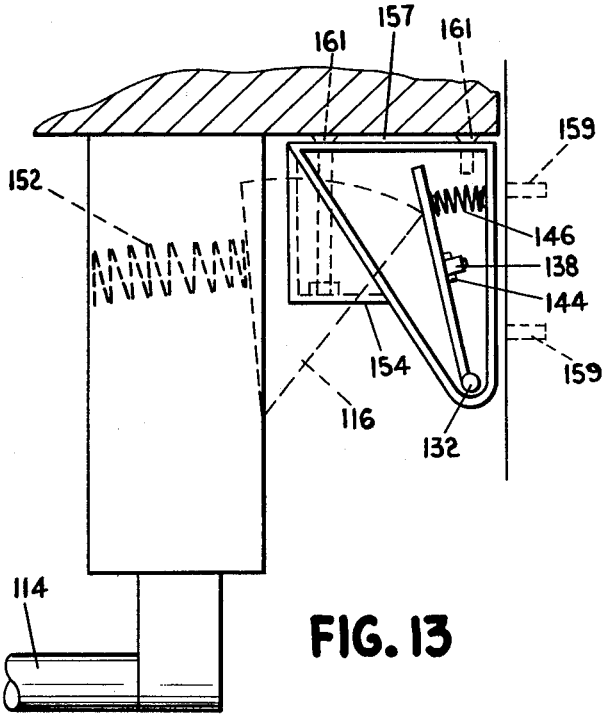
FIG. 13 is an enlarged plan view of the alarm switch of FIG. 12, showing additional components of the structure and showing the internal workings of the components with the latch in place.

When the plate is pivoted inwardly by engagement with latch 116, the plate causes the toggle to pivot in the manner shown in the phantom figure shown in FIG. 14. When thus pivoted, the lower end 148 of the toggle engages a contact assembly 150 of the same general design as described above and thereby prevents the actuation of the alarm signal as described above. The general movement of the mounting plate is shown in FIGS. 12 and 13, with the mounting plate shown in its outward or deactuated position in FIG. 12 and in its inward or actuated position shown in FIG. 13. Latch 116 is biased outwardly by springs 152 or the like in a conventional manner.

As in previous embodiments the contact assembly comprises terminals that fit through slots in the casing. These terminals make electrical contact with a terminal assembly 153 that fits in a recess in the casing. Wire guides 155 lead away from the terminal assembly. The terminal assembly and lower portion 128 of the casing are enclosed by a cover 154 which is attached by means of projections 156 on either side of the casing that fit in corresponding recesses or openings 158 in the cover.

The switch is mounted to the door jamb by means of an L-shaped bracket 157, one arm of which is attached by screws 159 or the like to the door jamb. The other arm of the bracket abuts the face of the door when it is closed. The switch is attached to this other arm by threaded fasteners 161. Other means for mounting the switch to other types of similar door assemblies are feasible.

Still another embodiment of the present invention is shown in FIGS. 15–19. This embodiment is designed to provide an alarm switch for a surface mounted dead bolt such as the type used on an overhead door 160 or the like. In overhead door 160 the door is opened and closed by sliding upwardly and downwardly in a frame or runner 162 formed of metal or the like and positioned adjacent to the sides of the door. To lock such a door a surface mounted dead bolt 164 is mounted for sideways movement on a mounting plate 166 and locks the door by extending through an opening 168 in the frame or runner 162. A handle 170 is used for sliding the bolt into and out of engagement in the hole in the frame, and brackets 172 hold the bolt in proper horizontal alignment.

The switch employed in this type of application comprises a casing or housing 176 attached by bolts 178 or the like (see FIG. 18) to runner 162. Casing 176 comprises a hollow rectangular casing having an open bottom side. A roller actuator 182 is mounted in a roller holder 184 in the interior of casing 176. Roller 182 has a shaft portion 186 protruding from the ends thereof, the ends of which are rotatably positioned in a groove 188 in the bottom side of roller holder 184. Shaft portion 186 extends outwardly beyond the sides of roller holder 184 and fits through an elongated opening 190 in each side of casing 176. Roller holder 184 also has an outwardly extending shaft portion 192 that fits through the same elongated opening 190 in each side of the casing. Shaft portions 186 and 192 cause the roller holder and roller to be maintained in proper alignment in the casing and constrain movement of the roller and roller holder to a vertical direction in the casing, as well as holding the roller and roller holder together.

The roller holder and roller are urged resiliently in a downward direction by means of springs 194 that extend from the upper surface of the casing to the upper surface of the roller holder. The springs are held in position on both casing and holder by small, opposed protrusions 195 in the roller holder and casing.

When the dead bolt is inserted through opening 168 in the frame and adjacent to the open bottom side of the alarm switch casing between the roller 182 and the bolt holder 212, the dead bolt engages roller 182 and causes the roller and roller holder 184 to move upwardly in the casing until the upper surface of the roller holder engages a contact assembly 196 of the same type as shown in previous embodiments. This contact assembly then actuates the alarm system in the manner described previously.

As in previous embodiments, contact assembly 196 is held in position by means of ridges 198 positioned on each side of the contact assembly at the top of the casing. The contact assembly has terminals of the type used in the assemblies of the previously described embodiments. These terminals extend through slots in the back of the casing. A terminal assembly 200 fits in a recessed portion of the back of the casing in the manner shown in FIG. 3. Wire guides 202 extend to the sides of the casing and then along the sides of the casing to the front of the casing to carry electrical leads.

A cover 204 having a back and three sides (an open bottom) fits over casing 176 and is held in place by projections 206 on the casing that fit into corresponding openings 208 in the cover.

The sides of the casing have recesses 210 adjacent the elongated opening 190, with the recessed portions having horizontally disposed serrated ridges 211 to serve as a gripping surface. A U-shaped bolt holding member 212 fits on the bottom of the casing, with a bottom portion 214 fitting on the underside of the casing and two upwardly extending portions 216 fitting into the ridges 211 of the casing. The inner surfaces of portions 216 are provided with similar gripping ridges so that they grip snugly ridges 211 of the casing.

The reason for a lower portion of the casing formed in this manner is that this lower portion 212 can be raised upwardly and downwardly with respect to the casing in order to provide a snug fit between the bolt and the roller after the casing itself has been bolted to the frame. This prevents the bolt from deflecting downwardly upon engagement with the roller. If the bolt were permitted to deflect downwardly, the bolt might not cause the roller to move upwardly a sufficient distance to engage the switch. It also acts as a physical barrier to the bolt being moved when the door is attempted to be opened.

Figure 16:
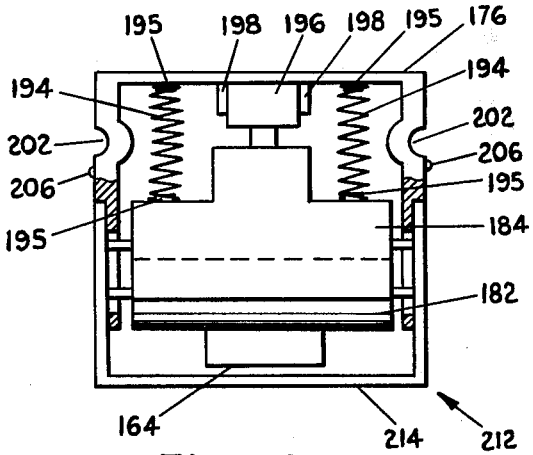
FIG. 16 is a view taken along lines 16—16 of FIG. 15, with the casing structure being removed to show the internal components of the alarm switch.
Figure 17:
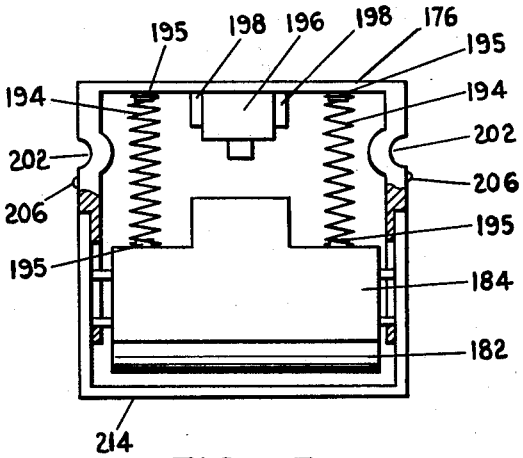
FIG. 17 is a view similar to FIG. 16, with the exception that the dead bolt is in its retracted position and not in contact with the alarm switch.
Figure 18:
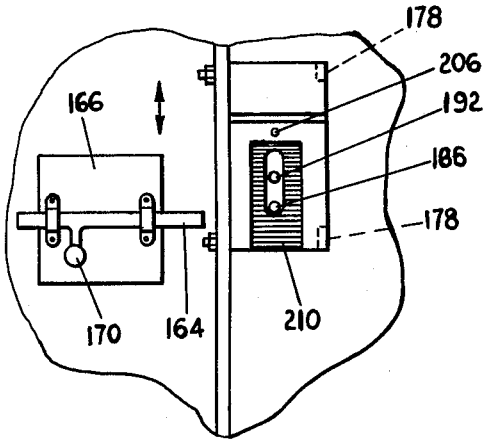
FIG. 18 is a view similar to FIG. 15, with the outside cover removed from the alarm switch.
Figure 19:
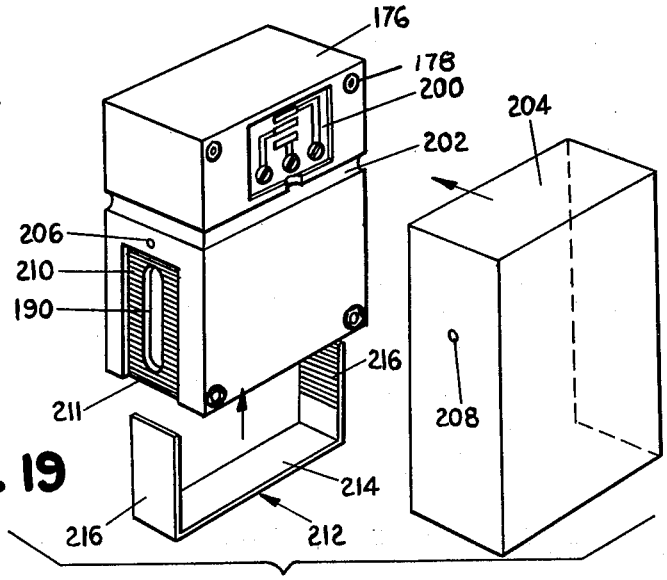
FIG. 19 is an exploded perspective view of the alarm switch of FIGS. 15–18 showing the cover casing structure, and bolt holding member.

The manner in which the bolt serves to actuate the switch is shown schematically in FIGS. 16 and 17. In FIG. 16 the bolt is inserted in the switch casing and the roller is raised into contact with the contact assembly. The bolt is removed from the switch casing in FIG. 17, thus deactuating the contact assembly.

It should be understood that the foregoing embodiments are merely exemplary of the preferred practice of the present invention and that various modifications and changes may be made in the embodiments shown herein without departing from the spirit and scope of the present invention.

The embodiments of the invention in which an exclusive property or privilege is claimed are defined as follows:

1. An electrical alarm switch for a door or window or the like wherein the door or window is locked in its closed position by a dead bolt or latch that engages a recess or opening in a door or window frame or adjacent door or window, the switch changing its electrical state when the dead bolt or latch is opened, the switch comprising:

a casing adapted to be mounted on the door or window or door or window frame the casing having a hollow interior portion;

an electrical contact assembly mounted in the casing, the contact assembly having a contact housing with an open interior and movable electrical contacts mounted therein, a movable actuator bar extending therefrom and positioned so as to change the open or closed state of the electrical contacts on movement of the actuator bar, the contacts being connected to terminals that protrude from the housing, the terminals extending through openings in the casing;

a terminal assembly mounted over the terminal openings in the casing, the terminal assembly having separate electrical contacts that engage each of the terminals of the contacts and having means for electrically connecting separate electrical leads from an alarm system to each contact;

a removable cover mounted over the casing so as to cover and conceal the terminal assembly;

a contact assembly actuating means movably mounted in the casing for engaging the actuator bar so as to change the electrical state of the contact assembly, the contact assembly actuating means being mounted and positioned such that a portion of the contact assembly actuating means engages the latch or dead bolt when it is closed, such engagement moving the contact assembly actuating means and changing the electrical state of the contact assembly, the contact assembly actuating means being biased to move back to its previous position when the dead bolt or latch is opened.

2. An alarm switch according to claim 1 wherein the contact assembly actuating means comprises a toggle member pivotably mounted in the casing, the toggle member having two arms extending from a pivotable member, a first arm being in position to engage the actuator bar and actuate the contact assembly, a second arm extending out of the casing, said second arm being of a size and length such that the switch can be positioned on the door or window frame of a door or window employing a dead bolt, with the second arm of the toggle extending through an opening in the frame leading into the dead bolt recess in the frame in a direction transverse to the direction of dead bolt movement into and out of said recess, the second arm, when so positioned, being engaged and moved by the closing of the dead bolt such that the first arm is caused to move and change the electrical state of the contacts.

3. An alarm switch according to claim 1 wherein the contact assembly comprises a toggle member with two arms extending outwardly from a pivot member pivotably mounted in the casing, a first arm extending into the casing for engagement with the actuator bar and actuation of the contact assembly upon pivoting of the pivot member, the other arm extending out of the casing and being positionable so as to be engaged and pivoted by the dead bolt or latch when it is closed, such engagement causing said first arm to actuate the contact assembly.

4. An alarm switch according to claim 3 wherein the switch is mounted on the exterior surface of the door or window frame, the second arm of the toggle extending through a transverse opening in the frame leading to the interior of a recess in the frame for a dead bolt extending from the door or window, the dead bolt, upon being locked and extended into the recess, engaging the second arm of the toggle and thereby causing sufficient pivotal movement of the second arm to cause the first arm to change the electrical state of the contact assembly, the switch including resilient biasing means for urging the contact assembly to its previous electrical state when the dead bolt is opened and withdrawn from the dead bolt recess.

5. An alarm switch according to claim 3 wherein the door is locked by a flush bolt that extends vertically from the door into the floor or the portion of the door frame above the door, the switch being mounted on the door over the flush bolt, the second arm of the toggle extending through a transverse opening in the door leading to the flush bolt, the second arm of the toggle including fastener means thereon for attaching the second arm to the flush bolt itself, such that vertical movement of the flush bolt causes actuating pivotal movement of the toggle.

6. An alarm switch according to claim 1 wherein the terminal assembly is mounted in a recess in the casing and includes a non-conductive plate that fits in the recess and a conductive circuit on the plate, the plate having openings that mate with the openings in the casing for the contact terminals, the plate having electrical contacts that engage the contact terminals and conductors thereon that lead to threaded fastener fittings, the threaded fastener fittings being attachable to the electrical leads for the alarm system.

7. An alarm switch according to claim 1 wherein the actuator bar protrudes from an opening in the contact assembly housing and includes resilient grommets thereon positioned on the inside and outside of the housing such that the resilient grommets cover the open space between the actuator bar and the contact housing and restrict dust and moisture infiltration into the contact housing.

8. An alarm switch according to claim 1 wherein the switch and contact assembly actuating means are adapted to be actuated by a door latch of the type used in an emergency door, such a door including a latch that extends outwardly from the side edge of the door to engage a door stop on the door frame, the switch being mounted on the door frame opposite the door latch, the contact assembly actuating member comprising a toggle pivotably mounted in the casing and having first and second arms attached to a pivotable member, the first arm being in a position to engage the actuator bar and actuate the contact assembly, the second arm being attached to a pivotable plate mounted on the casing, the pivotable plate being positioned opposite the door latch so as to be pivoted when the latch is closed, said pivotal movement causing the contact assembly to change its electrical state, a portion of the casing being positioned to engage the latch and prevent the door from opening when the latch is extended and the door is closed.

9. An alarm switch according to claim 1 wherein the switch is adapted for use in connection with a surface-mounted dead bolt, the contact assembly actuating member comprising a transversely movable member mounted in the casing, with the contact assembly being positioned such that transverse movement of the member engages the actuator bar and changes the electrical state of the contact assembly, the switch casing having an open portion such that the surface mounted dead bolt can engage the member when the bolt is extended, the member being formed such that engagement with the dead bolt as the dead bolt is extended causes transverse movement of the member to change the state of the electrical contacts.

10. An alarm switch according to claim 9 wherein said member is a roller, the roller being rotatably mounted in the casing by means of shaft portions that extend from the ends thereof and ride in longitudinal slots in side walls of the casing, the roller being in engagement with a roller holder transversely slidable in the casing in the same direction as the roller, the roller holder having protruding portions that ride in said longitudinal slots in the casing, the roller engaging the dead bolt and in turn causing the roller holder to slide transversely to engage the actuator bar.

11. An alarm switch according to claim 10 wherein the roller protrudes through an open side of the casing, the casing being positioned so that the dead bolt passes adjacent said side and engages the roller, the casing further including a bolt holding member that resiliently clips on the open side of the casing, a portion of the bolt holding member being positioned on the opposite side of the bolt from the roller and serving to restrain movement of the bolt in a transverse direction away from the roller, the position of the bolt holding member being adjustable in a direction toward and away from the roller.

12. An alarm switch for a door or window or the like employing a dead bolt comprising:

a casing mounted on the door or window frame over a dead bolt recess in the frame, the casing having an open interior and an opening in one side facing the frame;

an electrical contact assembly mounted in the casing and having a movable actuator bar means for changing the electrical state of the contact assembly, the contact assembly being connected to electrical circuit means for connecting the switch to an alarm system;

a pivotable contact assembly actuating means mounted in the casing for engaging the actuator bar and changing the electrical state of the contact assembly on extension and retraction of the dead bolt into and out of the dead bolt recess, the contact assembly actuating means comprising a toggle pivotably mounted in the casing and having first and second arms extending in opposite directions from a pivotable member, the first arm extending into the casing for engagement with the actuator bar on pivotal movement of the toggle, the second arm extending out of the casing through an opening in the door or window frame opposite the opening in the casing, said opening extending through the frame into the recess for the dead bolt in a direction transverse to the direction of the dead bolt in moving into and out of the recess, the second arm of the toggle extending into said recess in position to be engaged and moved by the dead bolt, the toggle being pivoted to change the electrical state of the contact assembly on movement of the dead bolt into and out of the dead bolt recess, whereby an appropriate electrical signal is transmitted to an alarm system.

* * * * *